US005397002A

United States Patent [19]

Lambert

[11] Patent Number: 5,397,002

[45] Date of Patent: Mar. 14, 1995

[54] VARIABLE CONTROL SCREEN APPARATUS

[76] Inventor: Gene F. Lambert, 2023 Cochran Rd., Maryville, Tenn. 37801

[21] Appl. No.: 61,444

[22] Filed: May 14, 1993

[51] Int. Cl.[6] ..... B07B 1/34

[52] U.S. Cl. ..... 209/347; 209/382; 209/404

[58] Field of Search ..... 209/382, 404, 322, 347, 209/381, 357, 349

[56] References Cited

U.S. PATENT DOCUMENTS

| | | | |
|---|---|---|---|
| 3,285,413 | 11/1966 | Taylor-Smith | 209/382 X |
| 3,796,311 | 3/1974 | Krause | 209/382 X |
| 4,169,788 | 10/1979 | Grunbaum | 209/382 X |
| 4,444,656 | 4/1984 | Nelson et al. | 209/347 |
| 4,575,420 | 3/1986 | Blachetta et al. | 209/347 X |
| 4,732,670 | 3/1988 | Nelson | 209/404 X |

FOREIGN PATENT DOCUMENTS

| | | | |
|---|---|---|---|
| 0256461 | 5/1988 | Netherlands | 209/382 |

*Primary Examiner*—D. Glenn Dayoan

[57] ABSTRACT

A vibrating screen apparatus having a pair of side members, a screen surface supported between the side members, a pair of frame members supported between the side members and beneath the screen, a first hammer to vibrate the screen, a second hammer that alternately vibrates the screen with the first hammer and a motor to impart motion to the hammers and frame members. The screen apparatus is provided with a method to selectively tension the screen surface. The apparatus is equipped to permit varying the frequency and amplitude of the hammers and screen material. The apparatus is equipped with only a single motor on each screen section to provide economy in use.

7 Claims, 5 Drawing Sheets

VARIABLE CONTROL SCREEN APPARATUS

BACKGROUND OF THE INVENTION

The present invention relates to a variable control screening apparatus, and more particularly, to a vibrating screen used to separate and sort multiple size solids and particulates.

Vibrating screen arrangements have been in use for many years in gravel and rock quarrying for screening and/or for dewatering wet material. Generally, the arrangements comprise a working member mounted on a frame and an exciter arranged to impart vibrating motion to the member. The working member is fitted with a screen deck with a conventionally rigid aperture element which may be made up of a plurality of screening panels.

Despite the fact that the working member is vibrated in use, blinding of the apertures often occurs. When blinding occurs, separation of particulars become less uniform and less efficient. It is therefore an object of this invention to reduce blinding and improve efficiency.

Vibrating screening decks have also been widely in use in the past for separating particles of various sizes and composition. Such screening deck typically comprise a rectangular frame suspended in operation with screen cloth mounted within the frame from which the materials are separated. The frame and screen in such decks are suspended at an angle. The entire frame is vibrated, thus imparting vibration to the machine which in turn causes the solids to move down the screen. As the materials move down the vibrating screen, the solids of smaller mesh size pass through the screen with larger solids discharged from the lower end of the screen.

One disadvantage of such prior screening devices is the substantial energy which must be imparted in vibrating the entire system. Decks of this size can typically employ vibration motors of 40 horsepower or more. Another disadvantage of such prior decks is their susceptibility to need frequent maintenance because of the substantial vibration imparted to the entire deck for sustained lengths of time.

Other screening devices have suffered from an inability to adjust the surface tension of the screening material. Various types of materials require different tensioning of the screening surface to provide maximum efficiency in separating and classifying solids and particulates. It is therefore an object of this invention to provide a means for adjusting the surface tension of the screening material.

Other screening apparatuses have been developed which attempt to reduce the substantial energy requirements. In these apparatuses, a plurality of smaller vibrators motors have been employed which are coupled to a tappet shaft extending beneath the screen material at various locations spaced along the length of the screen. The tappet shaft is coupled by relatively complex linkages to the vibrator motor on the exterior of the frame of the deck. A plurality of tappet arms are positioned on the shaft which move eccentrically to tap the screen from beneath. In such prior screening decks only the screen is vibrated rather than the entire frame and thus the energy consumption is reduced. The particular tappet arrangements in such decks necessitate relatively complex linkages and cause localized tapping of screen both of which result in concentrated wear. Such prior screening decks require frequent adjustment to keep the screen in contact with the tappets. Such prior screening decks are also subject to blinding problems. It is therefore an object of this invention to eliminate these complex linkages and frequent necessity for adjustment.

SUMMARY OF THE INVENTION

According to the invention a screening arrangement defining a feed end and a discharge end comprises a pair of elongated side frame members extending between the feed end and a discharge end, a pair of transverse screen support members attached to the side members, at least one of which is located at or toward each of the feed and discharge ends, at least one screen deck comprised of a flexible screen material extended between and secured to the transverse screen support members, at least one of the screen support members being movable relative to the other screen support member, a pair of frame support members, a first hammer means mounted to said frame support members and vibratably independent of said side frame, a second hammer means mounted to said frame support members and vibratably independent of said side frame and means to vibrate said first and second hammer means such that said first and second hammer means strike the screen material alternately. The screen apparatus may be held at an angle with the discharge end lower than the feed end thus permitting the screen material to form a downward slope which in turn permits particulates which do not fall through the screening material to be discharged through the discharge end.

These and other objects, features and advantages of the present apparatus will be clearly understood to those skilled in the arts.

DESCRIPTION OF THE PREFERRED EMBODIMENTS

Figure 1:
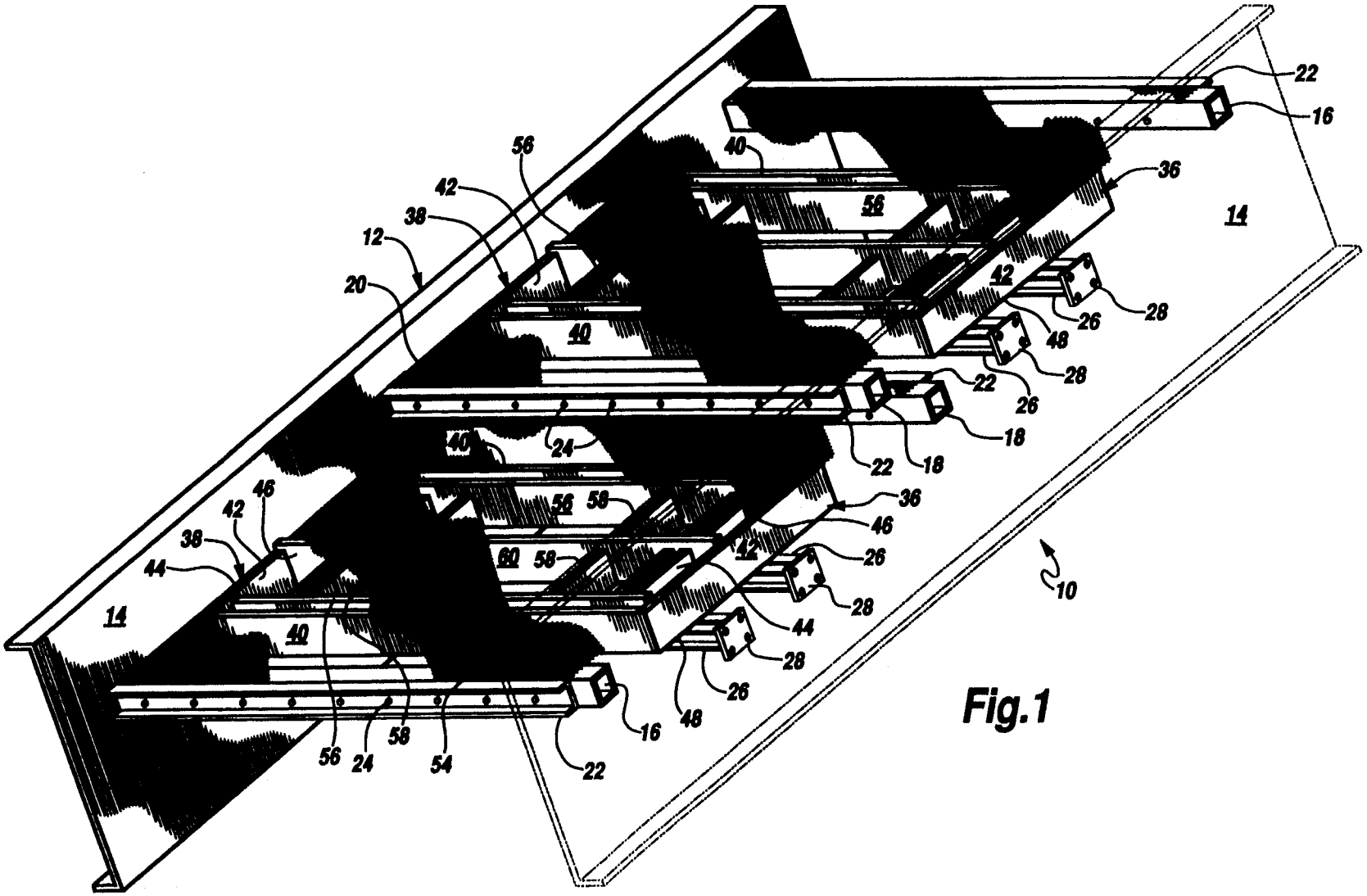
FIG. 1 is a perspective view of the preferred embodiment of the variable control screen apparatus partially broken to show the components of the deck underlying the screening.
Figure 2:
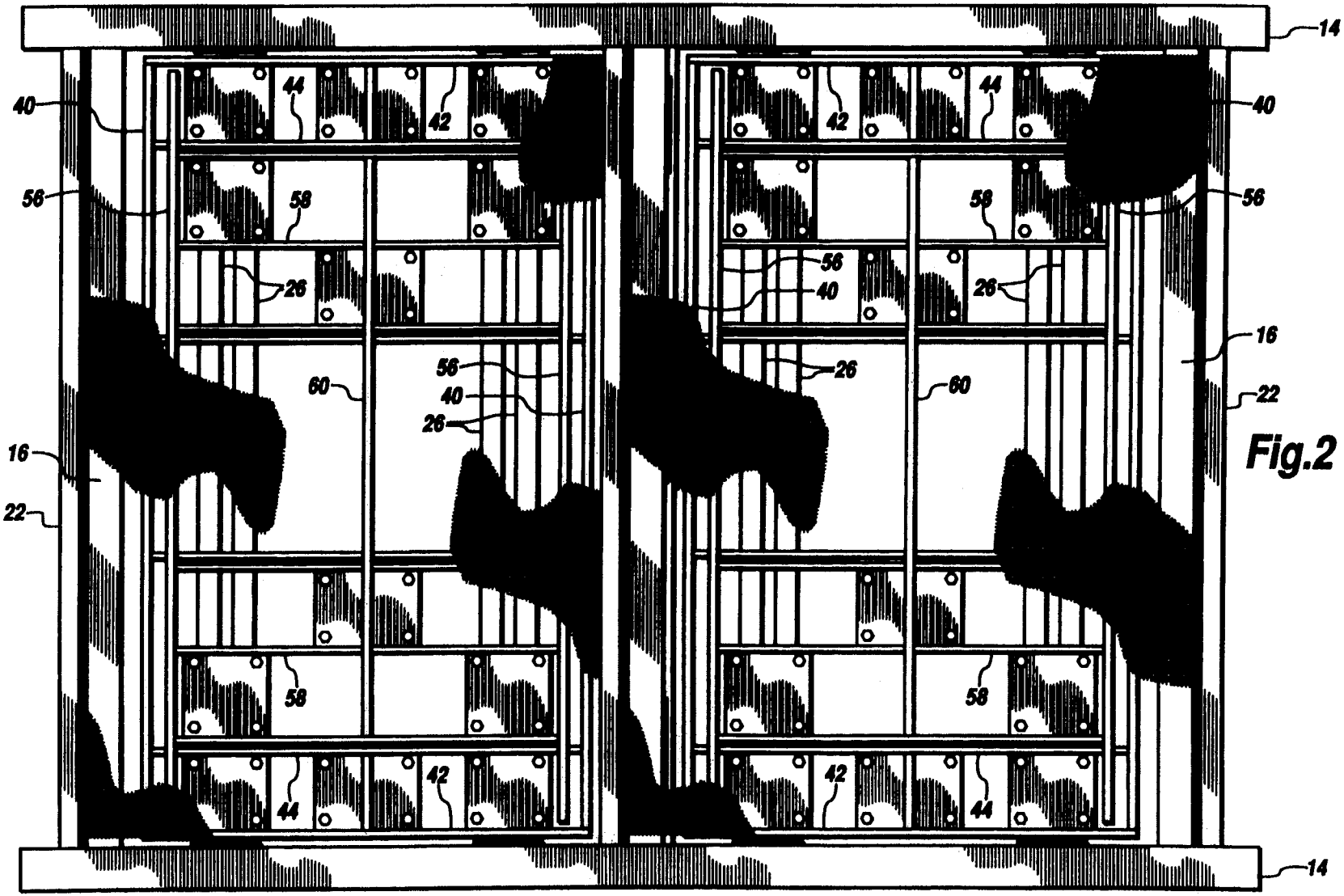
FIG. 2 is a top view of the variable control screen apparatus shown in FIG. 1.

An overall view of the variable control screening apparatus is shown in FIG. 1.

The screening apparatus 10 comprises a rigid frame, generally 12, having a pair of longitudinally extended elongated side members 14 such as channel beams shown in FIG. 1. The elongated frame members 14 are held apart and spaced in generally parallel relationship to each other by transverse members 16 as shown in FIG. 1.

Second transverse members 18 are spaced generally parallel to members 16 and likewise hold elongated members 14 apart. Said second members also provide support for the screening material 20.

Screening material 20 is contained within frame 10. Solids and particulates are passed over the screening material to be separated. The screening material is held in place by C-shaped members 22. The screening material 20 is placed above and over transverse members 16 and clamped in place by member 22 which in turn is held by conventional means such as bolts 24.

A plurality of rigid frame beams 26 are positioned transversely between side members 14 in space relationship to each other along the length of frame 12. Beams 26 preferably have an "I" cross-section. The ends of each beam 26 terminate in a flange plate 28 which is fixed thereto by suitable means such as welding. The flange plate in turn is mounted to the elongated members 14 in said frame 12, Resilient isolators 30 formed of rubber or other suitable resilient material is mounted on rigid beams 26, The resilient isolators are equipped with upper flange plate 32 and lower flange plate 34. Lower flange 34 is attached to beam 26, Bolts are preferably utilized to mount the lower flanges 34 to the beams 26, A means for imparting motion and vibration to the screening material is generally shown at 36, An outer hammer assembly 38 is provided, Side members 40 are provided and run generally perpendicular to side members 14 and parallel to beams 26, A pair of essentially parallel side members 42 are attached at each end to members 40 to form essentially a rectangle, A second pair of side members 44 are positioned parallel to side members 42 and attached at each end to parallel members 40. A spacer 46 is provided to permit additional contact with the screening material, Spacer 46 is positioned and attached at the side midpoints of side member 42 and side member 44. The lower edge of side member 42 is attached to outer resilient isolators 50 by means of an outer flange plate 52.

An inner hammer assembly 54 is provided. A pair of side members 56 is provided, Inner side members 56 run perpendicular to elongated side members 14 and essentially parallel to first hammer side members 40. Cross members 58 span between inner side members 56 and are essentially parallel to side members 42. Side members 42 are attached to inner side members 56 at their ends. A center member 60 is provided and runs essentially parallel to and between side members 56. Center member 60 is attached at each end to cross members 58. The lower edge 62 of cross member 58 rests on inner isolator 64.

A means to excite or vibrate the outer hammer assembly 38 and inner hammer assembly 56 is provided at 66. A pair of inner vibrators 68 are provided. A flange plate 70 is bolted to a second flange 72. Flange 72 is attached to cross members 58 at its lower edges 74. A second pair of vibrators 76 is provided and mounted outboard of inner vibrators 68 within elongated side members 14. A flange plate 78 is attached to the upper side of vibrators 76. A flange 80 is attached to the underside of side member 42 and second side member 44 at lower edge 82. A shaft 84 rotatively joins inner vibrators 68. A pair of second shafts 86 rotatively join each inner vibrator 68 to an outer vibrator 76. A conventional flexible coupling 88 joins the various shafts and vibrators. A conventional electric motor 90 is rotatably connected to one of the outer vibrators 76.

A surface tensioning means 92 is provided. A slot 94 is provided through side members 14. Second transverse member 18 is slidably placed within said slot. A channel formed by parallel members 96 and 98 and is welded on the outer side of elongated side member 14 and run in register with slot 94. The end of second traverse member 18 fits through slot 94 and is attached to coupling 100. A conventionally threaded screw member 102 is attached to coupling 100. A second screw member 104 is attached to bracket 106. An anchor bracket 108 is welded to the outer elongated side member 14. Screw members 102 and 104 are joined by an inner threaded member 110. A ratchet member 112 is ratchetably attached to the outer surface of member 110. As member 110 is rotated using ratchet 112 as a lever, coupling 100 is drawn toward anchor bracket 108. In turn, this moves member 18 away from member 16 thus increasing the tension on the surface of screening material 20.

An important feature of the present invention is controlling the frequency and amplitude of the screen vibration over the length of the screen during operation. Various materials separate better at different frequencies and amplitudes. Accordingly, the ability to control the frequency and amplitude is a desired quality of the present invention. To this end, the vibrators may be adjusted in order to impart the ideal frequency and amplitude at various locations along the screening material by adjusting the vibrators. It will be recognized by those skilled in the arts that adjusting the counter weights in the vibrator will increase or decrease the amplitude and frequency.

Vibration control circuits for motors 90 have not been shown because they are within the selection of one skilled in the art from a wide range of speed controls which have been employed for other purposes. It will be recognized by those skilled in the art that varying the speed of motor 90 will provide additional control of the frequency and amplitude of vibration imparted to screen material 20.

The operation of the variable screening apparatus according the invention is as follows:

The bulk material is loaded at the elevated end onto the top of screening surface 20. As a result of the vibrations imparted to the screening material, the material moves downward along the screening surface 20. As the material moves over the screening material 20, smaller particles drop through the apertures in the screening material 20.

Figures 3A, 3B, 3C:
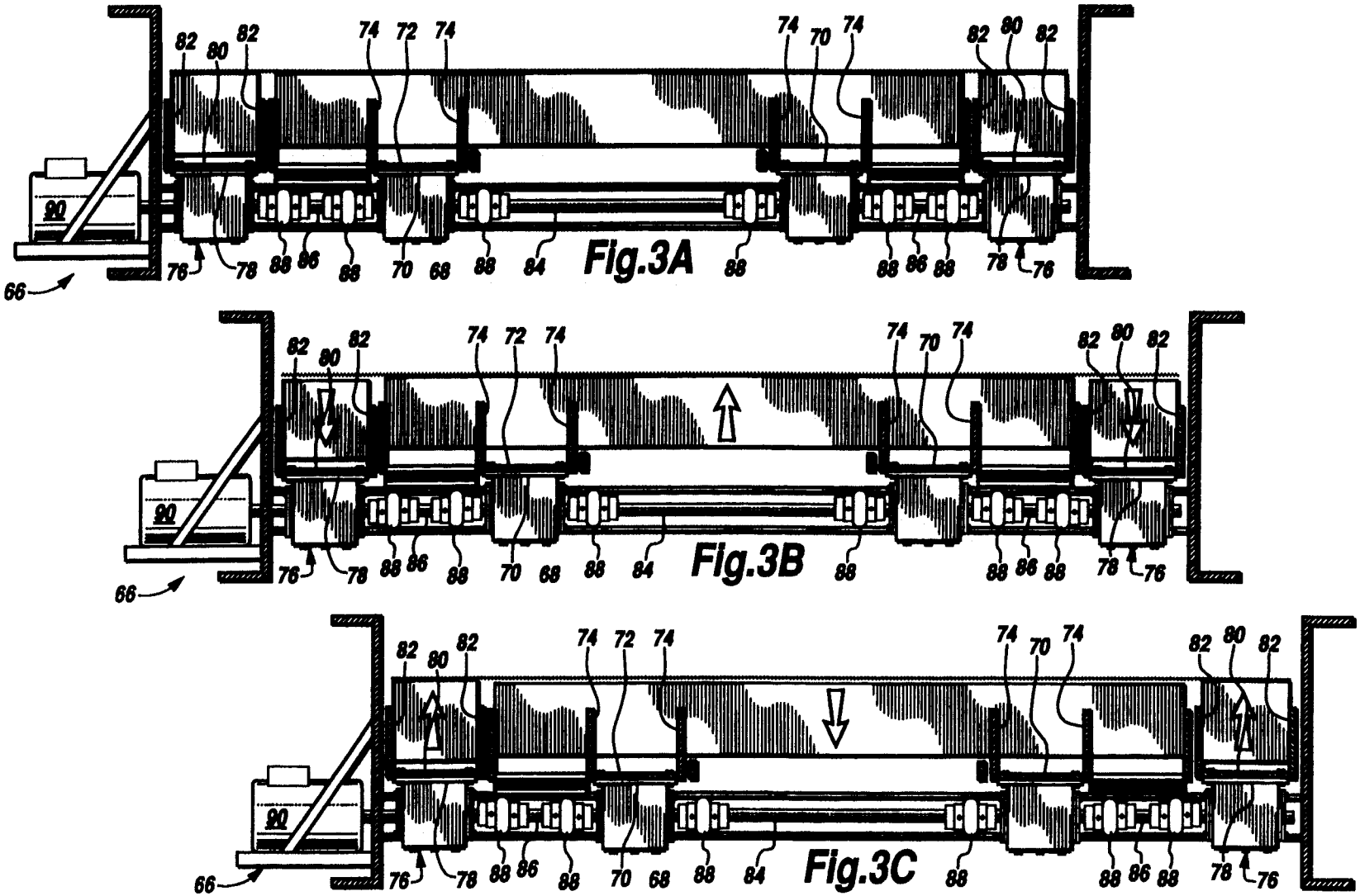
FIG. 3A is a cross-sectional and elevational view of the screening apparatus as viewed substantially along line 3—3 of FIG. 2 showing both hammer assemblies in contact with the screening material.
FIG. 3B is a cross-sectional end elevation view of the screening apparatus as viewed substantially along line 3—3 of FIG. 2 showing one hammer assembly in contact with the screening material.
FIG. 3C is a cross-sectional end elevation view of the screening apparatus as viewed substantially along line 3—3 of FIG. 2 showing the second hammer assembly in contact with the screening material.
Figure 4A:
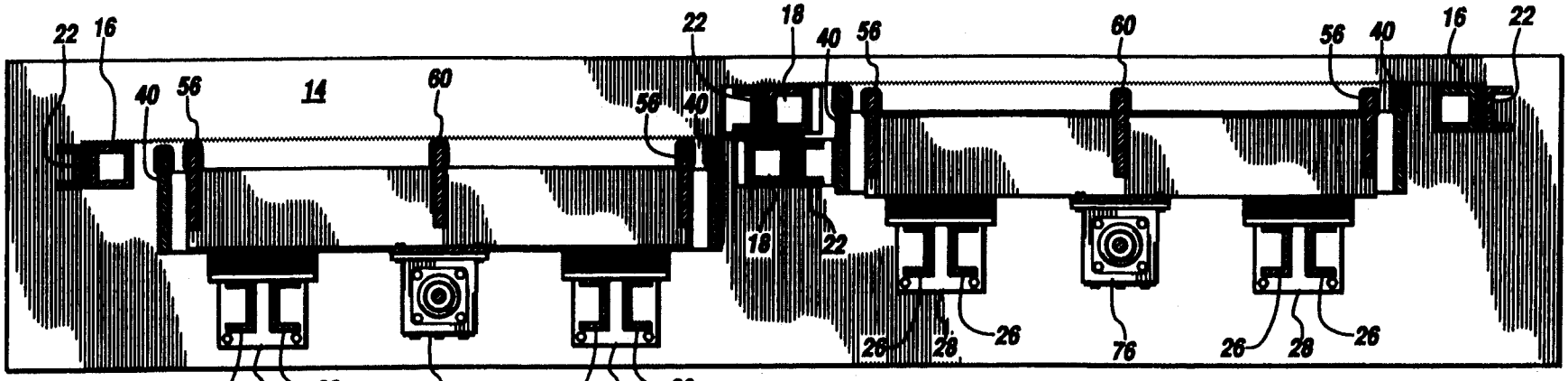
FIG. 4A is a cross-sectional side elevation view of the screening apparatus as viewed substantially along line 4—4 of FIG. 2 showing one of the hammer assemblies in contact with the screening material.
Figure 4B:
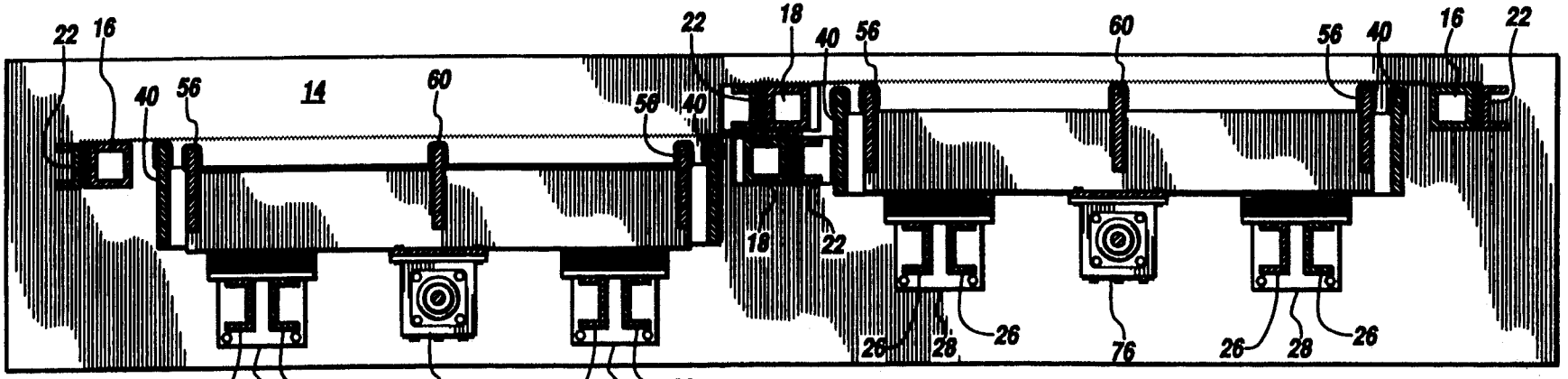
FIG. 4B is a cross-sectional side elevation view of the screening apparatus as viewed substantially along line 4—4 of FIG. 2 showing the other hammer assembly in contact with the screening material.
Figure 5:
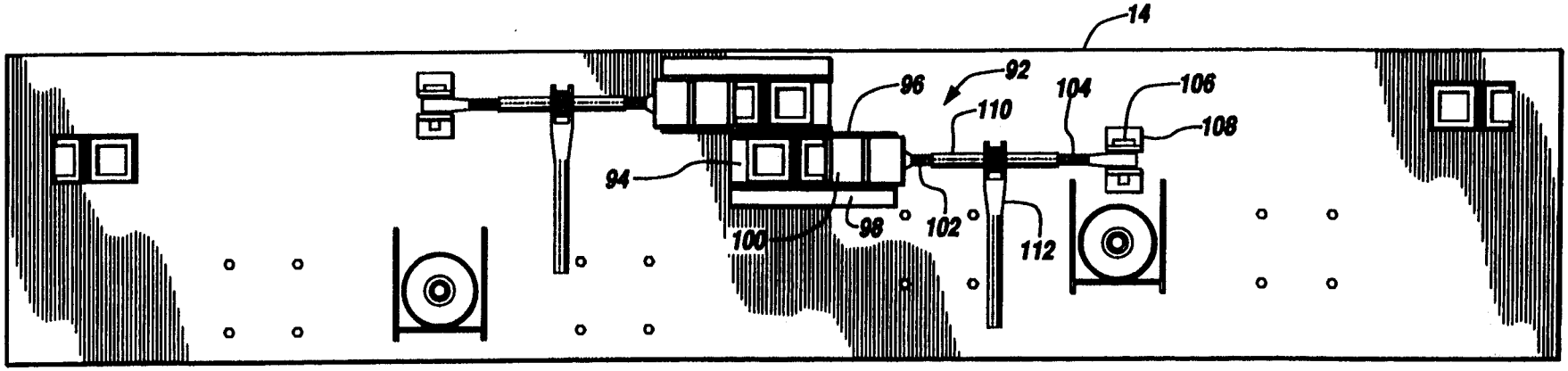
FIG. 5 is a side elevation view of the screening apparatus shown in FIG. 1.
Figure 6:
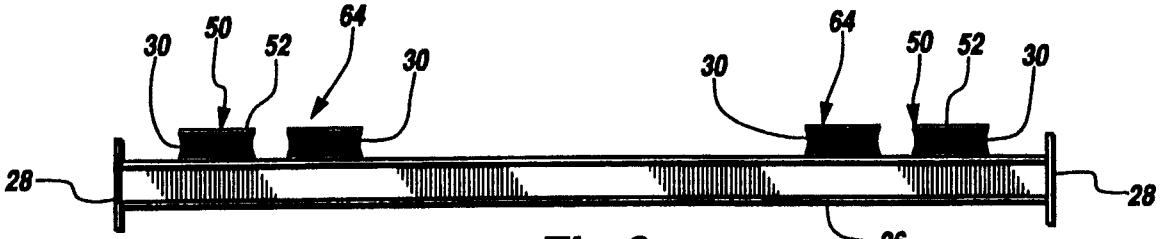
FIG. 6 is a support frame as viewed in FIG. 4A and FIG. 4B.

The vibration is imparted to the screening material by activating motor 90. Vibrators 68 are in 180 degree phase to vibrators 76. As the outer hammer assembly 38 strikes the under surface of screening material 20, the second hammer assembly 54 is retracted from and out of contact with the under surface of screening material 20. This motion is illustrated in FIG. 3C. As the outer hammer assembly 38 withdraws downward away from the underside of screening material 20, the second hammer assembly 54 rises and strikes the underside of screening material 20. This motion is illustrated in FIG. 3B. The alternating motions of hammer assembly 38 and hammer assembly 54 are 180 degrees out of phase with each other. Accordingly, hammer assemblies 38, 40 and 54 are not in constant contact with the underside of screening material 20.

Although the invention is described and illustrated with reference to a specific embodiment thereof, it is to be expressly understood that it is in no way limited to the disclosure of such a preferred embodiment, but is capable of numerous modifications within the scope of the intended claims.

What is claimed is:

1. A vibrating screen apparatus for separating bulk granulated material comprising:

a pair of spaced elongated side members, a screen surface supported between said side members, a pair of frame members supported between said side members beneath said screen surface, a first hammer means mounted on to said frame members vibratably independent of said side members and spaced from and beneath said screen, a second hammer means mounted on said frame members within said first hammer means vibratably independent of said side members and spaced from and beneath said screen, and vibrator means fixed to said first and second hammer means whereby said first and second hammer means alternately stirke said screen surface.

2. The vibrating screen apparatus of claim 1 including support means mounting said first hammer means and said second hammer means to said frame members isolating the vibrations of said first hammer means and said second hammer means from said side members.

3. The vibrating screen apparatus of claim 2 wherein said support means comprises resilient means mounted between said first and second hammer means and mounted between said frame member respectively.

4. The vibrating screen apparatus of claim 1, including a plurality of said frame members, said first and second hammer means, and said vibrator means along the length of said side members.

5. The vibrating screen apparatus of claim 1 including screen anchoring means mounted between said side members.

6. The vibrating screen apparatus of claim 1 wherein said vibrator means includes control means for varying the frequency and amplitude of said vibrator means.

7. The vibrating screen apparatus of claim 5 wherein said anchoring means comprises an elongated channel slidably mounted to said side members and means to selectively slide said elongated channel relative to said side members whereby the surface tension of the screen material may be varied.

* * * * *